United States Patent [19]

Byers

[11] Patent Number: 4,635,312

[45] Date of Patent: Jan. 13, 1987

[54] APPARATUS FOR CLEANING CONTAINERS

[76] Inventor: William L. Byers, 1902 S. Calhoun St., Fort Wayne, Ind. 46804

[21] Appl. No.: 790,340

[22] Filed: Oct. 23, 1985

[51] Int. Cl.[4] ..... B08B 9/08

[52] U.S. Cl. ..... 15/71; 15/56; 15/70

[58] Field of Search ..... 15/56–59, 15/62, 65, 66, 70, 71, 73, 76, 101; 134/6, 8

[56] References Cited

U.S. PATENT DOCUMENTS

| | | | |
|---|---|---|---|
| 1,149,812 | 8/1915 | Doering, Jr. . | |
| 1,151,538 | 8/1915 | Foreman | 15/62 |
| 1,482,489 | 2/1924 | Valerius et al. . | |
| 3,047,893 | 8/1962 | Anderson | 15/71 |
| 3,264,675 | 8/1966 | Di Ilio | 15/504 |
| 4,115,891 | 9/1978 | Wills | 15/71 |
| 4,173,053 | 11/1979 | Wills | 15/71 |

FOREIGN PATENT DOCUMENTS 1218501 12/1958 France .

*Primary Examiner*—Edward L. Roberts.

*Attorney, Agent, or Firm*—Anthony Niewyk; Albert L. Jeffers

[57] ABSTRACT

An apparatus for cleaning containers which includes a tank for holding a cleaning fluid. A rack which includes clamps for clamping the containers to be cleaned is movable from a loading position in an upper portion of the tank by sliding engagement with a track to a cleaning position in a lower portion of the tank wherein the brushes are in cleaning engagement with the containers. The rack is pivotable whereby the containers may be loaded in an upright position in the rack and may thereafter be pivoted to a sliding position wherein the rack slides downwardly along the track to its cleaning position.

19 Claims, 7 Drawing Figures

APPARATUS FOR CLEANING CONTAINERS

BACKGROUND OF THE INVENTION

This invention relates to a cleaning apparatus and in particular to a cleaning apparatus for cleaning containers such as paint cans.

In the sale of paints, agitators are placed in various cans of tint colors. These colors are then poured into empty cans to blend special mixes. Once the tint color cans are emptied the cans are disposed of. Since such cans are generally made of sheet metal and are therefore relatively expensive, it is desirable to provide an apparatus for cleaning such cans so that they can be reused. An additional advantage of reuse of the cans is the elimination of the can disposal problem.

Prior art can cleaning devices have been provided for cleaning cans, bottles and the like wherein a cleaning tank is provided including rotatable brushes located therein. The cans must be manually loaded onto the brushes for cleaning. One example of such an apparatus is disclosed in U.S. Pat. No. 4,115,891. This patent discloses a tank with a sloping bottom and a plurality of sleeves mounted on the sloping bottom. Rotatable shafts extend through the sleeves and have brushes mounted on the ends thereof. Clamps are attached to the sleeves for clamping cans onto the brushes. The brushes are then rotated and a pump supplies cleaning liquid to the brushes for cleaning the cans. A disadvantage of this apparatus is the need to manually load the cans onto the brushes as this may cause spillage of paint from the cans onto the operator or apparatus. Furthermore, the person loading the cans must lean over the tank which is filled with a cleaning fluid to load the cans onto the brushes which are located inside the tank. Additionally, the clamp structure disclosed in this patent is relatively complicated, making it difficult to clamp the cans onto the brushes for cleaning.

U.S. Pat. No. 4,173,053, shows an arrangement similar to the arrangement disclosed in the above discussed patent but further discloses a clamping structure which is attached to the lid of the tank in alignment with the brushes. Therefore, once the cans are loaded on the brushes and the lid is closed by the operator, the clamps hold the cans in place. In this arrangement the clamps are operated by a compressed air mechanism. This too is a rather complicated arrangement.

It is therefore desired to provide a can cleaning apparatus which is simple and economical in construction and which is easy to operate. It is furthermore desired to provide a can cleaning apparatus having a simple clamp structure wherein the cans may be loaded in the upright position into the clamping structure and wherein the cans may then be pivoted downwardly for engagement with the brushes. It is also desired to provide a can cleaning apparatus wherein no special pumps are needed for pumping cleaning fluid to the brushes.

SUMMARY OF THE INVENTION

The present invention overcomes the disadvantages of the prior art can cleaning apparatuses by providing an improved can cleaning apparatus therefor.

The can cleaning apparatus of the present invention comprises a tank for holding a cleaning fluid and having a sloping bottom. A plurality of rotatable brushes extend upwardly from the bottom of the tank for receiving cans thereon. A track is located along an inside wall of the tank and extends downwardly into the tank. The track slopes downwardly in a plane which is parallel to the axes of the cleaning brushes. A loading rack or carriage is provided, including a plurality of clamps for holding a plurality of cans in alignment with the brushes. The rack includes a pair of rollers for riding in the track. The rack is pivotable from a loading position wherein the cans are loaded into the clamps in an upright position to a sliding position wherein the rack is slidable in the track towards the brushes for cleaning engagement of the cans with the brushes.

One advantage of the structure according to the present invention is that it is relatively simple and economical to construct.

Another advantage of the apparatus according to the present invention is that the cans may be loaded into the rack in the upright position thereby avoiding spillage of paints and the like from the cans onto the machine or the operator.

Still another advantage of the present invention is that the cans, after loading into the rack, may be pivoted downwardly with a simple pivoting motion whereby the cans slide into engagement with the brushes.

A further advantage of the apparatus is that no special devices need to be provided to hold the cans in engagement with the brushes, as the weight of the rack and the cans themselves will keep the cans in engagement with the brushes.

A still further advantage of the present invention is that the cans may be loaded easily in an upright position in the clamping mechanism located in an upper portion of the tank so that the operator does not need to bend over the tank which contains the cleaning fluid.

A yet further advantage of the present invention is that no special pumps need to be provided to force cleaning fluid through the brushes for cleaning of the cans.

The present invention, in one form thereof, provides an apparatus for cleaning containers and comprising a tank for receiving a cleaning fluid, a rotatable brush for cleaning the container and which is disposed in a bottom of the tank. Means is provided for rotating the brush. A track is disposed in the tank and extends generally toward the brush. A movable rack is provided for clamping the container and includes a device for engaging with the track whereby the rack is movable from a loading position wherein the cans are loaded into the rack to a cleaning position wherein the brush is engaged with a container.

The present invention, in one form thereof, further provides an apparatus for cleaning cylindrical cans. The apparatus comprises a tank for holding a cleaning fluid and includes a sloping bottom. A plurality of rotatable brushes extend upwardly from the bottom for receiving the cans thereon. A track extends along an inner wall of the tank in a plane which is parallel to the axis of the brushes. A driving device is provided for rotating the brushes. A rack is provided which includes a plurality of clamps for holding a plurality of cans in alignment with the brushes. The rack includes devices for riding in the track. The rack is pivotable from a loading position wherein the cans are loaded into the clamps to a sliding position wherein the rack is slidable toward the brushes for cleaning engagement of the cans with the brushes.

The present invention, in one form thereof, still further provides an apparatus for cleaning cans and comprising a cleaning tank for holding a cleaning fluid. A rotatable brush is provided in a bottom portion of the tank and extends in a generally upright direction. A track is provided in the tank in alignment with the axis of the brush and extending from an upper portion of the tank to a bottom portion of the tank. A rack is provided for releasably clamping a container. The rack is engaged with the track for movement from a loading position in an upper portion of the tank to a cleaning position in a bottom portion of the tank wherein the brush engages and cleans the container.

It is an object of the present invention to provide a cleaning apparatus which is easy to operate and which is economical to construct.

Another object of the present invention is to provide a can cleaning apparatus wherein no special pumps are needed for cleaning the cans.

A further object of the present invention is to provide an apparatus wherein the cans may be loaded in an upright position into a clamping mechanism located in an upper portion of the tank.

Yet another object of the invention is to provide a can cleaning apparatus wherein the loading rack is pivotable and wherein, after loading the cans in an upright position, the rack may be pivoted to ride down a track for engagement of the cans with the cleaning brushes.

BRIEF DESCRIPTION OF THE DRAWINGS

The above mentioned and other features and objects of this invention, and the manner of obtaining them, will be more apparent and the invention itself will be better understood by reference to the following description of an embodiment of an invention taken in conjunction with the accompanying drawings wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DESCRIPTION OF THE PREFERRED EMBODIMENT

Figure 1:
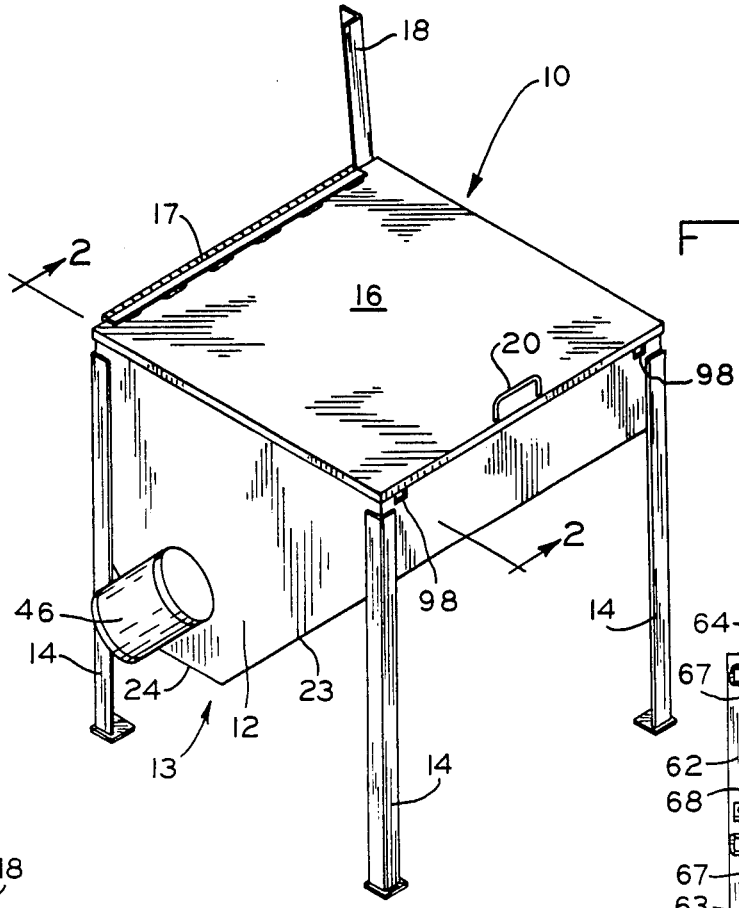
FIG. 1 is a perspective view of the can cleaning apparatus according to the present invention.

Referring now to FIG. 1, a perspective view of the can cleaning apparatus 10 is shown. The apparatus includes a tank 12 which is supported by legs 14 which, in the preferred embodiment, are illustrated as constructed of $1\frac{1}{4}$ inch angle iron. The apparatus also includes a lid 16 which is supported at the rear of the apparatus by means of a hinge 17. The lid may therefore be pivoted upwardly and is held in the upright position by means of a stop member 18.

Tank 12 includes a bottom 13 with sloping portions 22 and 23 which are connected by a horizontally oriented bottom portion 24. Portion 24 is provided with a valve 26 for selectively draining liquid from tank 12, as desired. A number of brush assemblies 34 are located inside tank 12. In the preferred embodiment four such brush assemblies 34 are illustrated although more or fewer brush assemblies 34 could be provided. Brush assemblies 34 each include a rim brush 36 and a barrel brush 38. Brush assemblies 34 are adapted to simultaneously clean both the inside and rims of cans as will be further described hereinafter.

Figure 2:
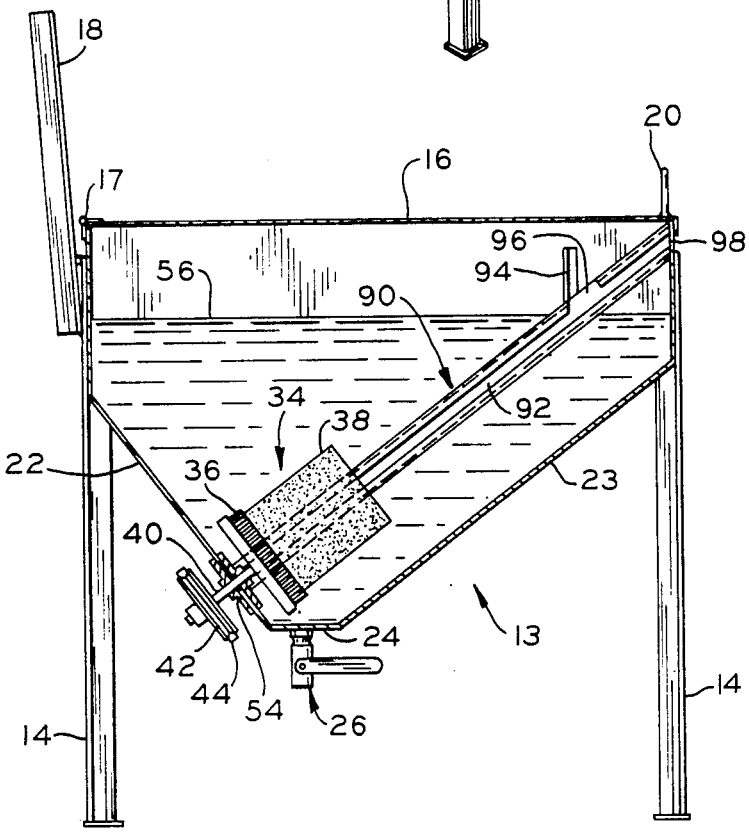
FIG. 2 is a cross-sectional view of the can cleaning apparatus of the present invention taken along lines 2—2 of FIG. 1.
Figure 3:
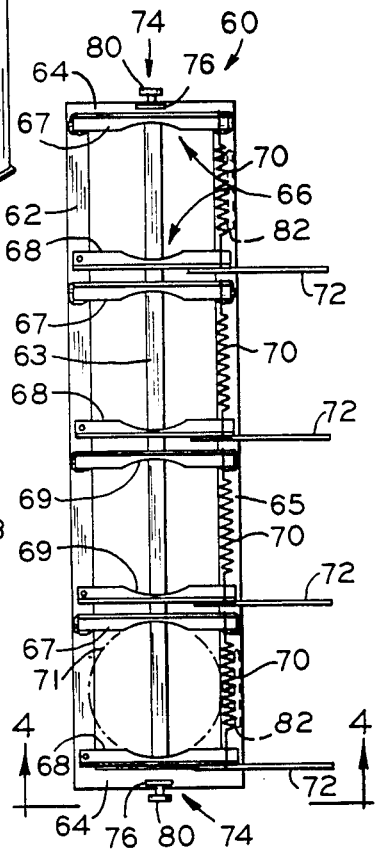
FIG. 3 is a top plan view of the clamping rack of the apparatus of FIG. 1 for clamping the cans to be cleaned.
Figure 4:
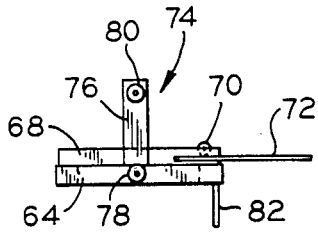
FIG. 4. is an end elevational view of the can clamping rack taken along lines 4—4 of FIG. 3.

Brushes 38 and 36 are cylindrical and are rotated by means of drive shafts or arbors 40. As best seen in FIGS. 2 and 7, each arbor 40 is provided with a pulley 42. Pulleys 42 are driven by means of an electric motor 46 which drives a belt 44 by means of a pulley 48 secured to the drive shaft (not shown) of motor 46. Tension is maintained on belt 44 by means of an idler assembly 50 including idler bearings 52. A spring 53 biases bearings 52 toward each other to maintain constant tension on belt 44. Tank 12 is sealed by means of plates 54 which include seals (not shown) therein for sealing rotatable arbors 40. The seals are preferably constructed of cork, as cork material is impervious to cleaning materials and therefore will not deteriorate as will other materials, such as for instance rubber. As can be seen by reference to FIGS. 2, 5 and 6, tank 12 may be provided with a cleaning liquid which fills the tank to a level indicated at 56. Thus the entire brush assemblies 34 are completely immersed in the liquid, and the cans, when they have been positioned for cleaning and are in contact with brushes 38 and 36, will also be immersed in the cleaning liquid.

Referring now to FIGS. 3–6 a rack or carriage 60 is provided including a rack frame 62 having side legs 64 and 65 and having a center leg 63. Rack 60 is also provided with container clamps 66. The number of clamps 66 is identical to the number of brush assemblies 34. Each clamp 66 includes a fixed clamp flange 67 and a laterally movable clamp flange 68. Fixed flanges 67 are secured to legs 65 by means of any suitable method such as welding or bolting. The entire frame 62 as well as clamp flanges 67 and 68 are comprised, in the preferred embodiment, of $1\frac{1}{4}$ inch angle iron. It should be understood however that other types and sizes of material could be used. Clamp flanges 67 and 68 have arcuate portions removed therefrom, thereby forming circular arcs 69 in flanges 67 and 68 for engagement with cylindrical cans. Movable flange 68 has a handle 72 secured thereto which is urged toward fixed flange member 67 by means of a tension spring 70. Movable flange 68 is also provided with pins, bolts or the like which extend through matching slots (not shown) in parallel frame legs 65, thereby preventing disengagement of flanges 68 from legs 65. Thus, by moving handles 72 laterally away from fixed clamp flanges 67, each of flanges 68 may be moved laterally away from its mating fixed clamp flange 67, thereby enlarging the space between the fixed and movable clamp flanges 67 and 68 and enabling the insertion of a can between the two flange members 67 and 68. A can 71 is shown in the loading position in FIG. 1, after can 71 has been inserted and after clamp 68 has returned to its normal position under the urging power of tension spring 70. Since tin cans normally have a soldered rim, this soldered rim may be captured beneath flanges 67 and 68, whereby can 71 is securely held in place and cannot move out of clamp 66. It should also be noted that center leg 63 of rack 60 prevents downward movement of the cans 71 in the loading position of rack 66.

It should be understood that, while clamps 66 are provided to clamp tin cans having soldered rims, other clamps could be provided for clamping other types of containers such as for instance bottles, plastic containers or the like.

Continuing further with FIGS. 3–6, rack 60 is provided with a guide assembly 74 including an arm 76 having rollers 78 and 80 rotatably secured thereto by means of pins (not shown) or the like. Two guide assemblies 74 are provided for rack 60, each of which is secured to a rack frame side member 64 by means of welding, bolting, or the like. Frame 62 is also provided with a rack handle 82.

Figure 5:
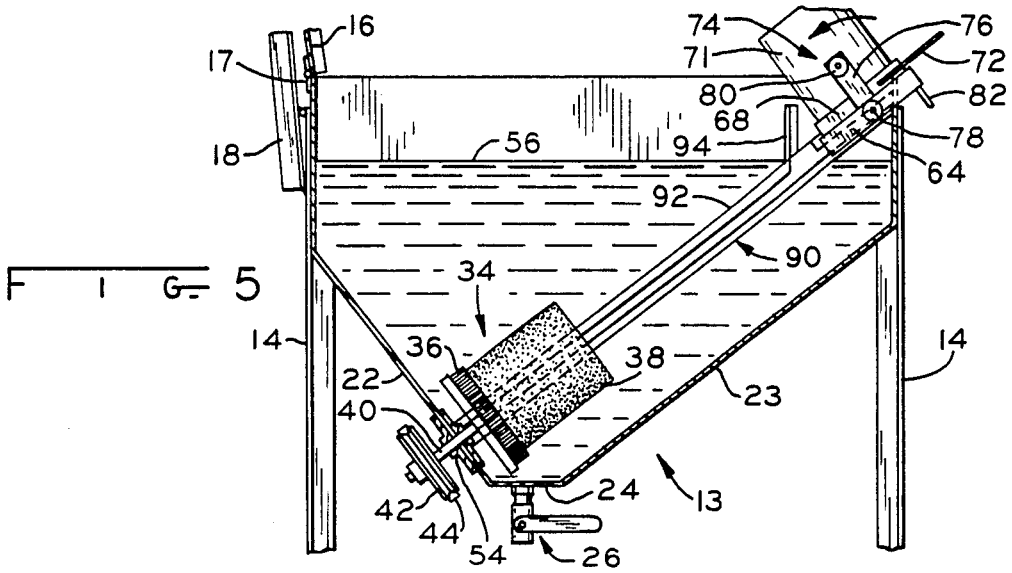
FIG. 5 is a cross-sectional view of the cleaning apparatus taken along line 2—2 of FIG. 1 with the rack in the loading position.
Figure 6:
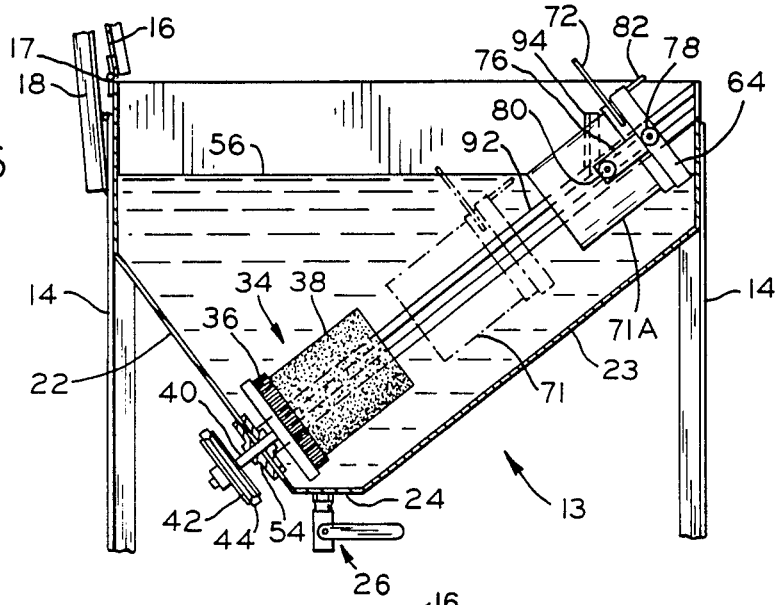
FIG. 6 is a cross-sectional view of the cleaning apparatus taken along lines 2—2 of FIG. 1 with the rack in its pivoted sliding position.
Figure 7:
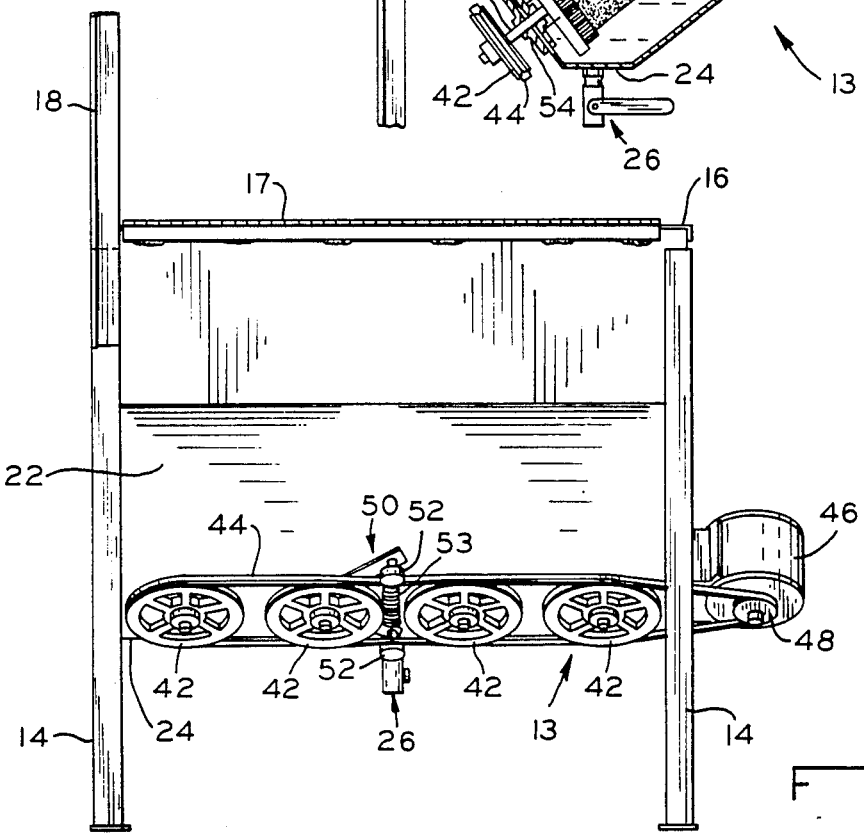
FIG. 7 is a rear elevational view of the apparatus of FIG. 1 disclosing the driving mechanism for the cleaning brushes.

Referring now to FIGS. 2, 5 and 6, the apparatus is provided with two tracks 90 located inside tank 12. One each of these tracks is secured to a side member of tank 12 by bolting, welding or other suitable fastening method. Racks 90 each include a slot 92 through which the pins (not shown) of rollers 78 and 80 extend as rack 60 slides down tracks 90. Lowermost roller 80 of guide assembly 74 is always in rolling engagement with track 92. Each of tracks 90 also includes a guide member 94 which extends generally vertically upwardly from track 90. Slots 96 are cut into tracks 90 adjacent upstanding guide members 94. As illustrated in FIG. 1, when rack 60 is pivoted in the counterclockwise direction as the operator pulls upwardly on handle 82 with the rack in the loading position near the top portion of the track, guide members 74 are pivoted counterclockwise together with rollers 78 so that rollers 78 are guided through slots 96 by guide members 94 and into tracks 92. The rack or carriage 60 is now in its sliding position wherein it can slide down track 90 toward brush assembly 74 as illustrated in FIG. 6.

In operation, by referring to FIGS. 5 and 6, rack 60 is first moved toward the upper portion of track 90 and is pivoted into the upright loading position wherein cans 71 may be loaded into clamps 66. Arms 72 are moved laterally, one at a time, whereby cans 71 may be loaded into clamps 66 while cans 71 are in the upright position. It should be understood that, while four handles 72 are shown, all of the movable clamp members 68 could be ganged together and operated by a single handle 72.

When rack 60 is in its loading position, it is retained in this position because legs 64 of rack 60 extend through slot 98 in the front wall of tank 12 and thereby prevent downward movement of rack 60 until handle 82 is lifted and the rack is released from slots 98.

After loading cans 71, handle 82 is lifted upwardly to cause rack 60 to pivot in the counterclockwise direction about roller 78 whereby rollers 80 will enter slots 96 for engagement with track 90 so that rack 60 is in the sliding position. Rack 90 is now guided downwardly toward brush assemblies 34. Cans 71, in their clamped position, are aligned with brush assemblies 34, whereby barrel brushes 38 will enter cans 71 until the rims of cans 71 engage rim brushes 36. Rack 60 is now in its cleaning position. Lid 16 is now closed and motor 46 is energized to rotate brush assemblies 34. It has also been found that, by properly orienting barrel brushes 38 with respect to their direction of rotation, brushes 38 will exert a screw effect on cans 71 and pull cans 71 downwardly for engagement of the can rims with rim brushes 36.

Since the brushes and the cans are all completely immersed in the cleaning liquid, no special pumps need to be provided to supply cleaning fluid to the brushes. In the preferred embodiment the apparatus is used for cleaning paint cans. It has been found that a satisfactory cleaning fluid for cleaning paint cans is perchlorethylene. This fluid is relatively safe for use as its flash point is relatively high. However, it should be noted that the apparatus may be used for cleaning other types of containers and that other types of suitable cleaning fluids may also be used.

While this invention has been described as having a preferred design, it will be understood that it is capable of further modification. This application is therefore intended to cover any variations, uses, or adaptations of the invention following the general principles thereof and including such departures from the present disclosure as come within known or customary practice in the art to which this invention pertains and fall within the limits of the appended claims.

What is claimed is:

1. An apparatus for cleaning a container comprising:
a tank for receiving a cleaning fluid;
rotatable brush means for cleaning container and disposed in a bottom portion of said tank;
means for rotating said brush means;
a track disposed in said tank at an inclined angle with respect to the horizontal plane and extending generally toward said brush means; and
movable rack means for clamping a container and including means for engaging with said track whereby said rack is movable from a loading position wherein container is loaded into said rack in a substantially upright position, to a cleaning position wherein said container is inverted and said brush means is engaged with selected surfaces of the container, the rack remaining engaged with said track in both said loading and cleaning positions.

2. The apparatus of claim 1 wherein said brush means comprises a plurality of brushes and wherein said rack means is adapted to clamp a plurality of containers, each said clamped container being aligned with one of said brushes as said rack moves from said loading position to said cleaning position.

3. The apparatus of claim 1 wherein said rack means includes a clamp, said clamp including resilient means for releasably clamping a container.

4. The apparatus of claim 3 wherein said clamp means includes first and second flanges, said first flange being laterally movable and including handle means, said first flange being urged toward said second flange by resilient means, whereby said first flange may be moved laterally by said handle against the urging force of said resilient means to enable a container to be inserted between said first and second flanges, said resilient means causing said flanges to clamp said container when said handle is released.

5. The apparatus of claim 1 wherein said movable rack means comprises pivotable means whereby said rack means is pivotable from said loading position wherein a container is clamped in a generally upright position to a sliding position wherein said rack is slidable along said track to said cleaning position.

6. The apparatus of claim 1 wherein said engaging means comprises roller means for riding in said track.

7. The apparatus of claim 6 wherein said rack is pivotable from said loading position to a sliding position whereby said rack is slidable to said cleaning position, said roller means includes a first roller engaged by said track and a second roller which is disengaged from said truck in the loading position of said rack, said second roller engaging said track when said rack is pivoted into said sliding position wherein said first and second rollers engage said track when said rack moves from said sliding position to said cleaning position.

8. The apparatus of claim 1 wherein said brush means includes a rim brush and a barrel brush for respective cleaning engagement with the rim and inside walls of a cylindrical container.

9. The apparatus of claim 1 wherein said means for rotating said brush means comprises an electric motor.

10. An apparatus for cleaning cylindrical cans, said apparatus comprising:

a tank for holding a cleaning fluid and including a sloping bottom;

a plurality of rotatable brushes extending upwardly from said bottom for receiving said cans thereon;

a track extending along an inside wall of said tank in a plane parallel to the axes of said brushes;

means for rotating said brushes;

a rack including a plurality of clamps for holding a plurality of cans in alignment with said brushes, said rack including means for riding in said truck, said rack being pivotable from a loading position wherein said cans are loaded into said clamps to a sliding position wherein said rack is slidable toward said brushes for cleaning engagement of said cans with said brushes.

11. The apparatus of claim 10 wherein each of said clamps includes first and second flanges, said first flanges being laterally moveable and including handle means, said first flange being urged toward said second flange by resilient means, whereby said first flange is laterally movable by said handle against the urging force of said resilient means to enable a can to be inserted between said first and second flanges, said resilient means effective to cause said first and second flanges to clamp a can when said handle is released.

12. The apparatus of claim 10 wherein said rack includes a handle, said rack being pivotable from said loading position wherein a can may be clamped in a generally upright position to said sliding position wherein said rack is movable along said track to said cleaning position.

13. The apparatus of claim 10 wherein said means for riding comprises roller means.

14. The apparatus of claim 13 wherein said roller means includes a first roller engaged by said track and a second roller which is disengaged from said track in the loading position of said rack, said roller engaging said track when said rack is pivoted to the sliding position, whereby said first and second rollers engage said track when said rack is pivoted from said loading position to said sliding position.

15. The apparatus of claim 10 wherein each of said brushes includes a rim brush and a barrel brush for respective cleaning engagement with the rim and inside wall of cylindrical cans when said rack is in the cleaning position.

16. An apparatus for cleaning containers comprising:

a cleaning tank for holding a cleaning fluid;

a rotatable brush in the bottom portion of said tank and extending in a generally upright direction;

an inclined track disposed in said tank in alignment with the axis of said brush and extending from an upper portion of said tank to a bottom portion of said tank;

a pivotable rack for releasably clamping a container, said rack being slidably engaged by said track for selective pivoting and sliding movement from a loading position in an upper portion of said tank wherein said container is clamped in a generally upright position to a cleaning position in a bottom portion of said tank wherein said container is clamped in a generally inverted position and wherein said brush engages and cleans said container.

17. The apparatus of claim 15 wherein said rack includes a clamp, said clamp including resilient means for resiliently realeasably clamping a container.

18. The apparatus of claim 17 wherein said clamp includes first and second flanges, said first flange including a handle means, said first flange being urged toward said second flange by resilient means, whereby said first flange may be moved laterally by said handle against the urging force of said resilient means, to enable insertion of a container in a generally upright position between said flanges, said resilient means causing said flanges to clamp said retainer when said handle is released.

19. The apparatus of claim 16 wherein said rack includes a first roller engaged by said track and a second roller which is disengaged from said track in the loading position of said rack, said second roller engaging said track when said rack is pivoted to said sliding position, whereby said first and second rollers engage said track when said rack moves from said sliding position to said cleaning position.

* * * * *

UNITED STATES PATENT AND TRADEMARK OFFICE

CERTIFICATE OF CORRECTION

PATENT NO. : 4,635,312

DATED : January 13, 1987

INVENTOR(S) : William L. Byers

It is certified that error appears in the above-identified patent and that said Letters Patent is hereby corrected as shown below:

Claim 7, Col. 7, line 4, change "truck" to --track--;

Claim 10, Col. 7, line 26, change "truck" to --track--.

Signed and Sealed this

Twenty-fifth Day of August, 1987

*Attest:*

DONALD J. QUIGG

*Attesting Officer*

*Commissioner of Patents and Trademarks*